US005879036A

United States Patent [19]

Moline et al.

[11] Patent Number: 5,879,036

[45] Date of Patent: Mar. 9, 1999

[54] DOOR INTERLOCK FOR AN APPLIANCE SUCH AS A WASHER

[76] Inventors: Steven S. Moline, 1725 Marquette Ave., Oshkosh, Wis. 54901; William J. Quandt, 44 Highland Ave., Ripon, Wis. 54971

[21] Appl. No.: 716,472

[22] Filed: Sep. 19, 1996

[51] Int. Cl.[6] ..... E05C 3/04

[52] U.S. Cl. ..... 292/210; 70/283; 70/280; 292/341.16; 292/DIG. 69

[58] Field of Search ..... 292/210, 341.16, 292/DIG. 24, DIG. 26, DIG. 69, 346, 203; 70/280, 283, 279; 200/61.64, 61.62, 61.67, 61.7; 68/3 R, 12.26; 134/57 DL, 58 DL

[56] References Cited

U.S. PATENT DOCUMENTS

| | | | |
|---|---|---|---|
| 2,370,781 | 3/1945 | Cullum | 292/346 |
| 2,786,701 | 3/1957 | Povlich | 292/341.16 X |
| 2,891,560 | 6/1959 | Ullman, Jr. et al. | 134/58 DL |
| 2,936,892 | 5/1960 | McNeil et al. | 292/DIG. 69 X |
| 3,390,909 | 7/1968 | Nagel | 292/341.16 X |
| 3,673,824 | 7/1972 | Ripsco et al. | 68/12.26 |
| 3,889,078 | 6/1975 | Wessman | 200/61.64 |
| 3,953,991 | 5/1976 | Grossman | 292/DIG. 65 X |
| 4,211,443 | 7/1980 | Butt et al. | 292/341.16 |
| 4,277,094 | 7/1981 | Roue | 70/280 |
| 4,314,217 | 2/1982 | Krasser | 70/280 |
| 4,510,777 | 4/1985 | Ellingson et al. | 68/12.26 |
| 4,623,179 | 11/1986 | Davis et al. | 292/DIG. 69 X |
| 4,697,442 | 10/1987 | Stendal | 292/346 |
| 5,044,680 | 9/1991 | Baker et al. | 292/278 |
| 5,072,974 | 12/1991 | Henne | 292/DIG. 69 X |
| 5,323,628 | 6/1994 | Mori et al. | 292/DIG. 69 X |
| 5,520,424 | 5/1996 | Hapke et al. | 292/DIG. 69 X |

FOREIGN PATENT DOCUMENTS

| | | | |
|---|---|---|---|
| 1170822 | 5/1964 | Germany | 292/DIG. 69 |
| 2181177 | 4/1987 | United Kingdom | 292/DIG. 69 |

*Primary Examiner*—Darnell M. Boucher
*Attorney, Agent, or Firm*—Marshall, O'Toole, Gerstein, Murray & Borun

[57] ABSTRACT

A door interlock includes a pivot arm having a door lock position, a door unlock position, and a latch recess. A latch has a door lock position against the pivot arm, a door unlock position releasing the pivot arm, and a latch projection. A latch operating solenoid is the only solenoid mechanically linked to the latch. A capacitor is supplied by a power supply and is arranged to pulse the latch operating solenoid without pulling down the power supply. The pulsing of the latch operating solenoid by the capacitor causes the latch operating solenoid to move the latch projection of the latch into and out of the latch recess of the pivot arm so that a door is locked and unlocked.

22 Claims, 10 Drawing Sheets

DOOR INTERLOCK FOR AN APPLIANCE SUCH AS A WASHER

TECHNICAL FIELD OF THE INVENTION

The present invention is directed to a door interlock for an appliance and, more particularly, to a door interlock for a horizontal axis washer.

BACKGROUND OF THE INVENTION

It is generally desirable to restrict access to the interior of an appliance, such as a horizontal axis washer, during its operation. For example, if the door of a horizontal axis washer is opened while the washer is in operation, (i) the user is exposed to the rotating wash basket of the washer, and/or (ii) hot wash water may flood out of the washer. Accordingly, such an appliance requires a door interlock in order to reduce the risk that the appliance door will be opened during operation of the appliance.

Door interlocks currently used in connection with horizontal axis washers are subject to tampering and/or improper adjustment during end use operation, field servicing, and/or factory assembly. Also, these door interlocks require multiple solenoid actuators. Such door interlocks are bulky and not particularly suited for use in connection with narrow width cabinet machines. Moreover, door interlocks in use today rely primarily on thermoactuators in order to provide automatic door interlock release in the event of a power loss. Because of variations in ambient temperatures, thermoactuators do not permit uniformity of release times. Furthermore, current door interlocks waste power.

The present invention is directed to a door interlock which solves one or more of the above noted and other problems.

SUMMARY OF THE INVENTION

According to a first aspect of the present invention, a door interlock comprises a pivot arm, a latch, and an electromagnetic latch operating means. The pivot arm has a door lock position, a door unlock position, and a latch recess. The latch has a door lock position, a door unlock position, and a latch projection. The electromagnetic latch operating means operates the latch to its door lock position when the pivot arm is moved to its door lock position so that the latch projection of the latch is seated within the latch recess of the pivot arm, and for operating the latch to its door unlock position so that the latch projection of the latch is withdrawn from the latch recess of the pivot arm and so that the pivot arm is released to move to its door unlock position.

According to another aspect of the present invention, a door interlock for a door of a horizontal axis washer comprises a pivot arm, a latch, a latch operating solenoid, and a solenoid operating means. The pivot arm locks the door and has a door lock position and a door unlock position. The latch has a door lock position against the pivot arm and a door unlock position releasing the pivot arm. The latch operating solenoid is the only solenoid mechanically linked to the latch. The solenoid operating means operates the latch operating solenoid to move the latch to its door lock position when the pivot arm is moved to its door lock position and operates the latch operating solenoid to move the latch to its door unlock position to permit the pivot arm to be moved to its door unlock position.

According to yet another aspect of the present invention, a door interlock comprises a pivot arm, a latch, a latch operating actuator, a power supply, and a capacitor. The pivot arm has a door lock position and a door unlock position. The latch has a door lock position against the pivot arm and a door unlock position releasing the pivot arm. The latch operating actuator is mechanically linked to the latch. The capacitor is supplied by the power supply and is arranged to pulse the latch operating actuator without pulling down the power supply. The pulsing of the latch operating actuator by the capacitor causes the latch operating actuator to move the latch between its door lock and door unlock positions.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
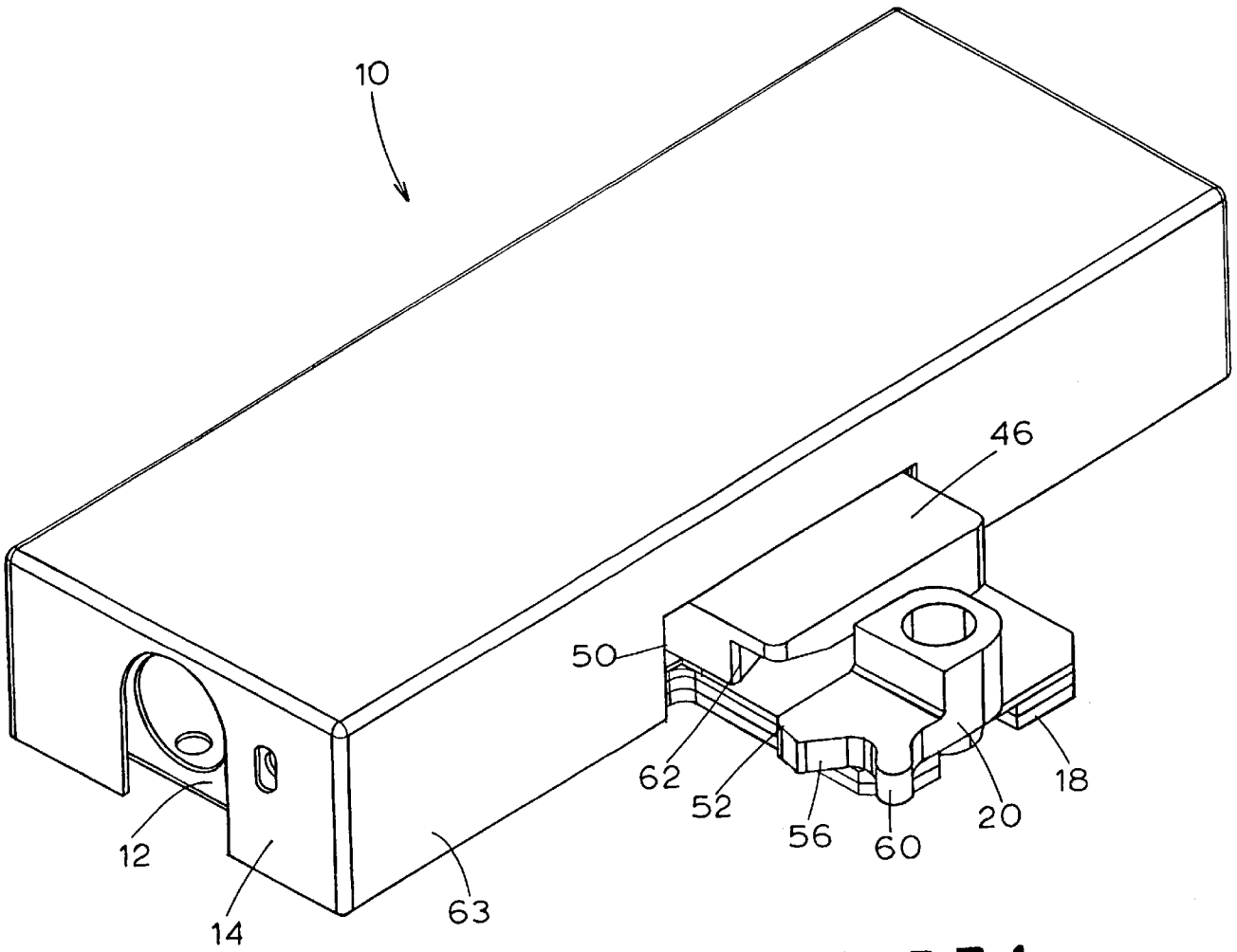
FIG. 1 is an isometric view of the door interlock according to the present invention and shows the door interlock in an unlock position.

As shown in FIGS. 1–6, a door interlock 10 includes a base 12 and a cover 14 which cooperate to form a housing compartment 16. One or more bracket spacers 18 are secured to the base 12 so that they are external of the housing compartment 16. The bracket spacers 18 support a pivot arm 20 which may be operated by an appliance lever (not shown) associated with the appliance on which the door interlock 10 is used. Thus, when the appliance on which the door interlock 10 is used is to be operated, the door of the appliance is closed, and the appliance lever is manipulated in order to lock the appliance door. When the appliance lever is so manipulated, the pivot arm 20 pivots between the unlock position shown in FIGS. 1, 2, and 5, and the lock position shown in FIGS. 3, 4, and 6.

Contained within the housing compartment 16 is an actuating arm 22 and a latch 24. The actuating arm 22 has a pivot 26, and the latch 24 has a pivot 28. A normally open door switch 30 and a normally closed latch switch 32 are secured to the base 12 within the housing compartment 16. The door switch 30 has a switch actuator 34 which cooperates with the actuator arm 22, and the latch switch 32 has a switch actuator 36 which cooperates with the latch 24. A solenoid actuator 38 is also secured to the base 12 within the housing compartment 16. The solenoid actuator 38 has an actuator shaft 40. A pin 42 (see FIGS. 5 and 6) extends between the actuator shaft 40 and a hole 44 in the latch 24. Accordingly, the pin 42 mechanically links the actuator shaft 40 to the latch 24 so that the latch 24 is moved by movement of the actuator shaft 40.

A latch block 46 is secured to the base 12 and extends through a cutout 48 in the base 12 and through a corresponding cutout 50 in the cover 14. The latch block 46, in cooperation with the base 12, the cover 14, and the pivot arm 20, limits access to the latch 24 within the housing compartment 16 when the pivot arm 20 is in its lock position.

Figure 2:
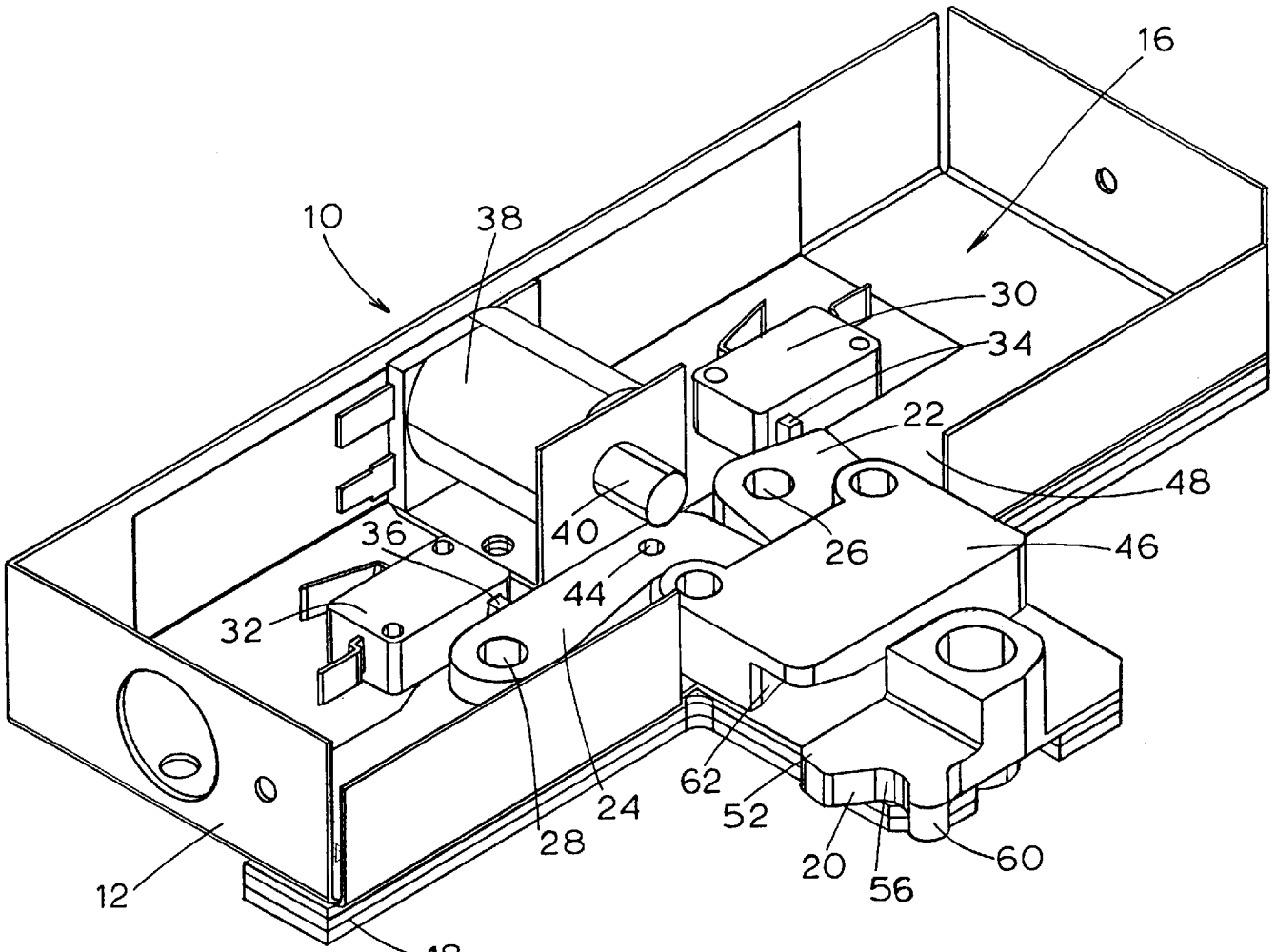
FIG. 2 is an isometric view of the door interlock of FIG. 1 with a cover of the door interlock removed.
Figure 5:
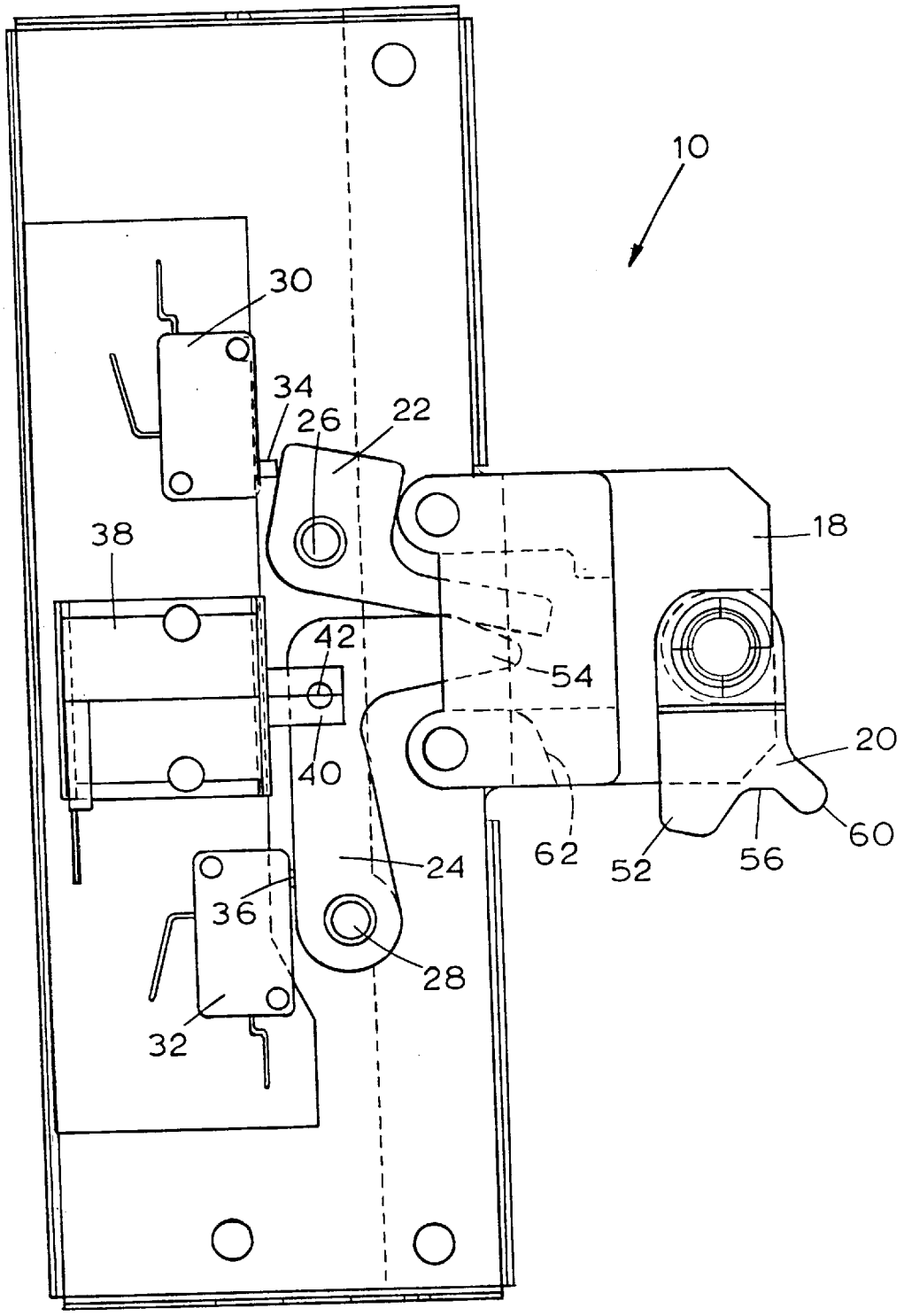
FIG. 5 is a top, partially phantom view of the door interlock of FIG. 1 and shows the door interlock in the unlock position.

The door interlock 10 is shown in its unlock position in FIGS. 1, 2, and 5. Accordingly, the door interlock 10 permits access through the door of an appliance, such as a horizontal access washer. When the end user desires to operate the appliance, the end user closes the door of the appliance and swings the appliance lever to its door locking position. As the appliance lever is swung, the pivot arm 20 pivots. As the pivot arm 20 pivots, an edge 52 of the pivot arm 20 contacts the actuator arm 22 and causes the actuator arm 22 to rotate about its pivot point 26 until the pivot arm 20 and the actuator arm 22 assume the positions shown in FIG. 6.

Figure 6:
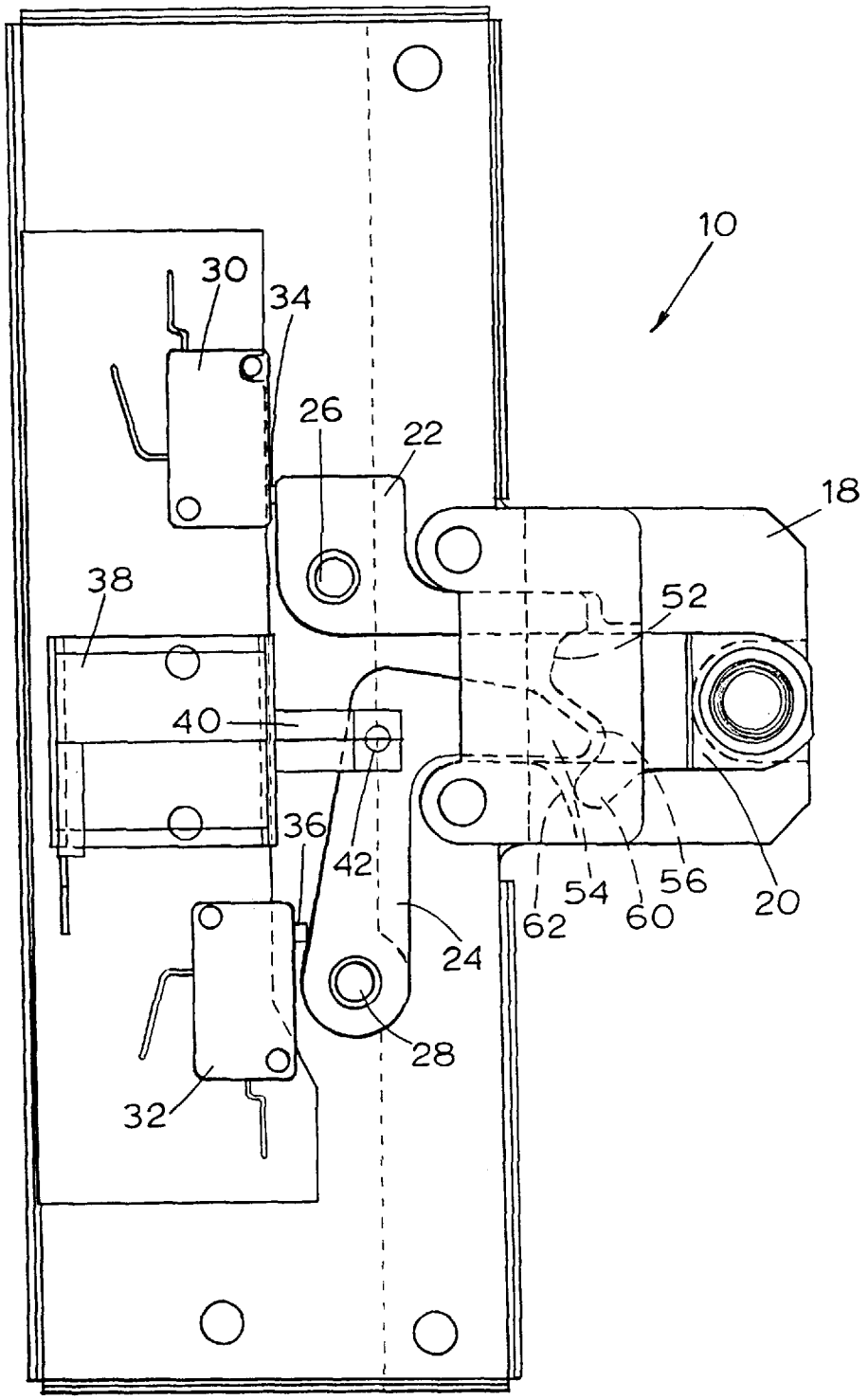
FIG. 6 is a top, partially phantom view of the door interlock of FIG. 3 and shows the door interlock in the lock position; and, FIGS. 7–10 show a circuit for controlling the door interlock of the present invention.

When the actuator arm 22 is rotated into its door lock position as shown in FIG. 6, the switch actuator 34 closes the door switch 30. At this point, the latch 24 has not been actuated yet to its lock position. However, the closure of the door switch 30 provides a signal to an appliance controller (not shown) that the appliance is in a condition to be locked by the solenoid actuator 38. When the appliance controller provides the proper instruction, the solenoid actuator 38 is energized. Accordingly, the actuator shaft 40 is driven out by the solenoid actuator 38 causing the latch 24 to pivot around its pivot 28. As the actuator shaft 40 is fully extended by the solenoid actuator 38, a latch projection 54 of the latch 24 enters a latch recess 56 of the pivot arm 20. When the latch projection 54 fully enters the latch recess 56, the latch 24 is in its lock position which prevents the pivot arm 20 from being rotated out of its door lock position and which operates the switch actuator 36 to close the latch switch 32. That is, with the latch projection 54 in the latch recess 56, the pivot arm 20 cannot be rotated by the appliance lever in order to open the door of the appliance. Closure of the latch switch 32 confirms to the appliance controller that the appliance door is locked. The door interlock 10 is shown in its door lock position in FIGS. 3, 4, and 6.

Figure 3:
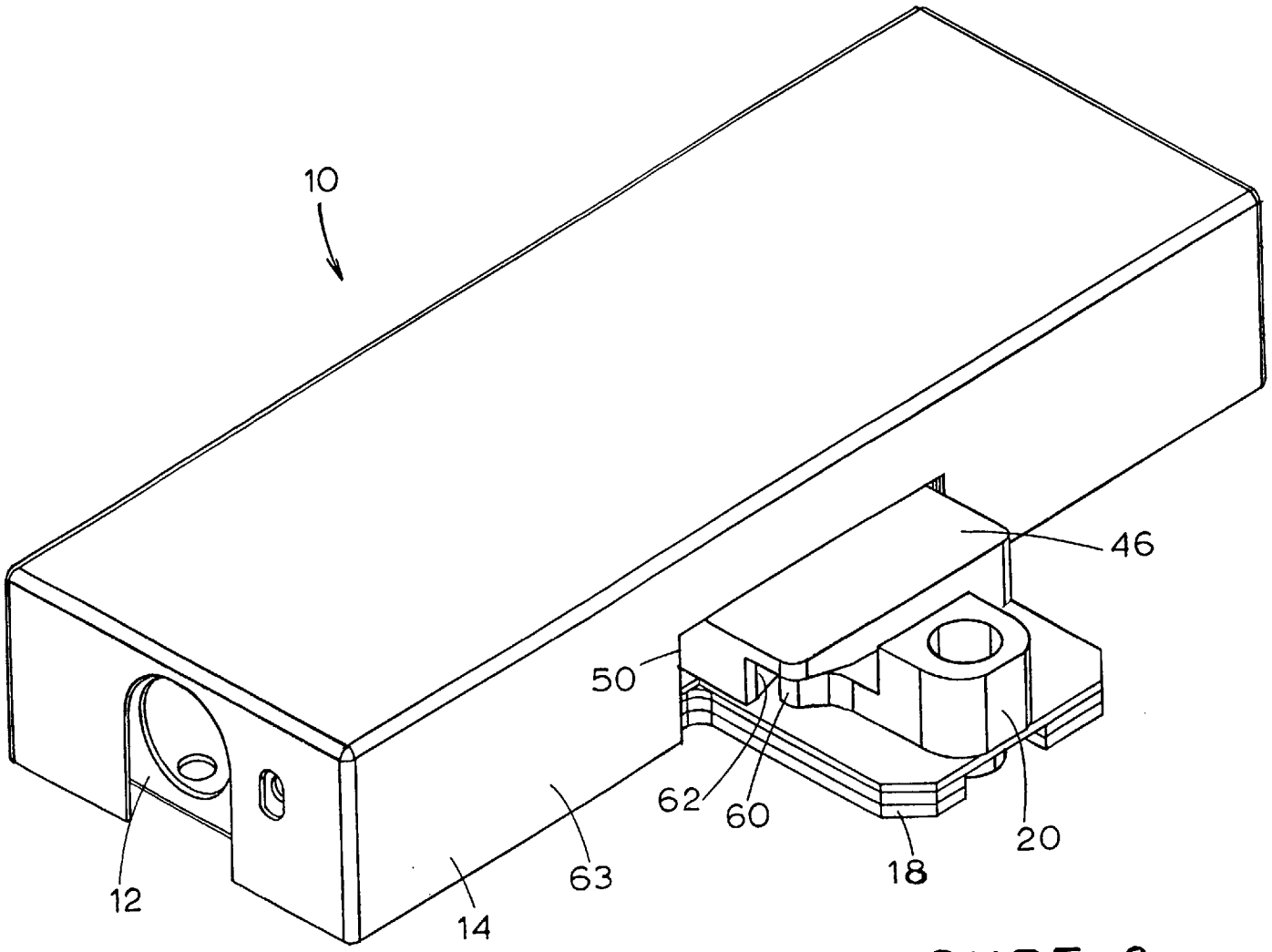
FIG. 3 is an isometric view of the door interlock of FIG. 1 and shows the door interlock in a lock position.
Figure 4:
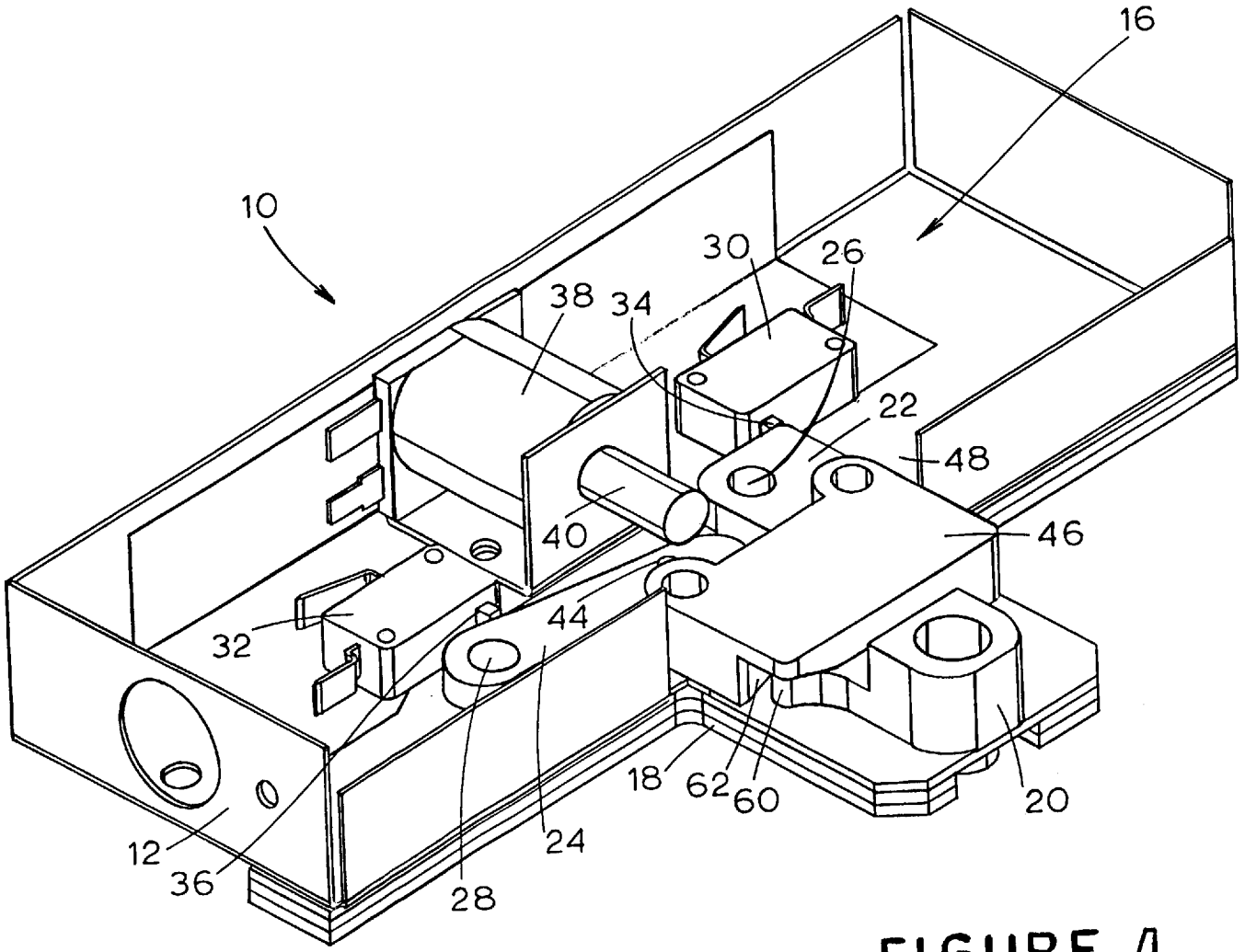
FIG. 4 is an isometric view of the door interlock of FIG. 3 with a cover of the door interlock removed.

The door of the appliance, therefore, cannot be opened until the solenoid actuator 38 retracts the actuator shaft 40 and the latch 24 in order to withdraw the latch projection 54 from the latch recess 56 of the pivot arm 20. The latch recess 56 is formed in the pivot arm 20 between the edge 52 and a thumb 60. As shown in FIGS. 3, 4, and 6, the thumb 60 of the pivot arm 20 cooperates with a wall 62 of the latch block 46 in order to restrict access to the latch 24. That is, the latch block 46 and the pivot arm 20 may be dimensioned so that there is very little clearance between the thumb 60 and the wall 62 when the pivot arm 20 is locked by the latch 24. For example, a 0.3 inch clearance may be provided between the thumb 60 and the wall 62. Accordingly, this feature of the present invention inhibits tampering of the door interlock 10.

Moreover, the door interlock 10 may be positioned so that a wall 63 is the bottom horizontal surface of the door interlock 10 when the door interlock 10 is mounted to the appliance. Accordingly, upon a power failure when the door interlock 10 is operating to lock the door of the appliance, gravity mechanically maintains the door lock positions of the actuator shaft 40 and the latch 24 so that the latch projection 54 of the latch 24 remains in the latch recess 56 of the pivot arm 20. Moreover, the actuator arm 22 is constructed so that, when a power failure occurs, gravity exerts a force on the actuator arm 22 urging the actuator arm 22 toward its non-actuated, unlock position. Consequently, if a power failure should occur while the door interlock 10 is locking the appliance door, the door interlock 10 cannot release the appliance until it is directed to do so by a door interlock control circuit 68 as shown in FIGS. 7–10.

Figure 7:
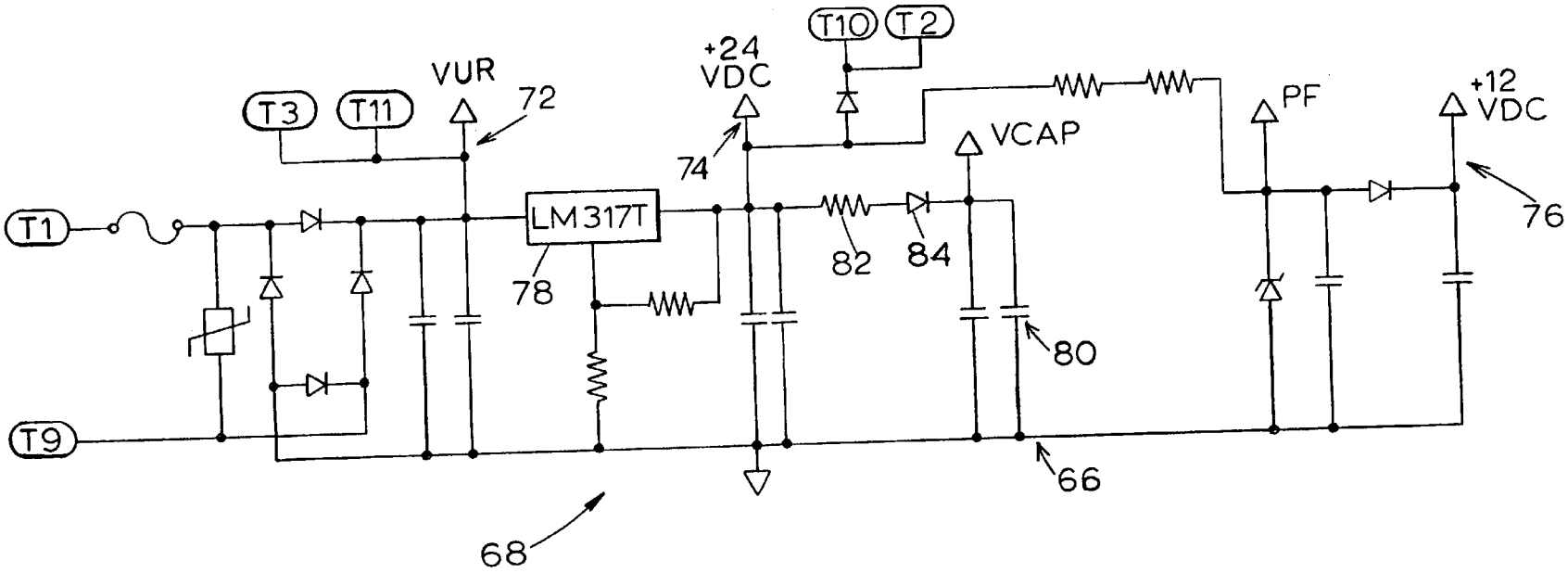
Figure 8:
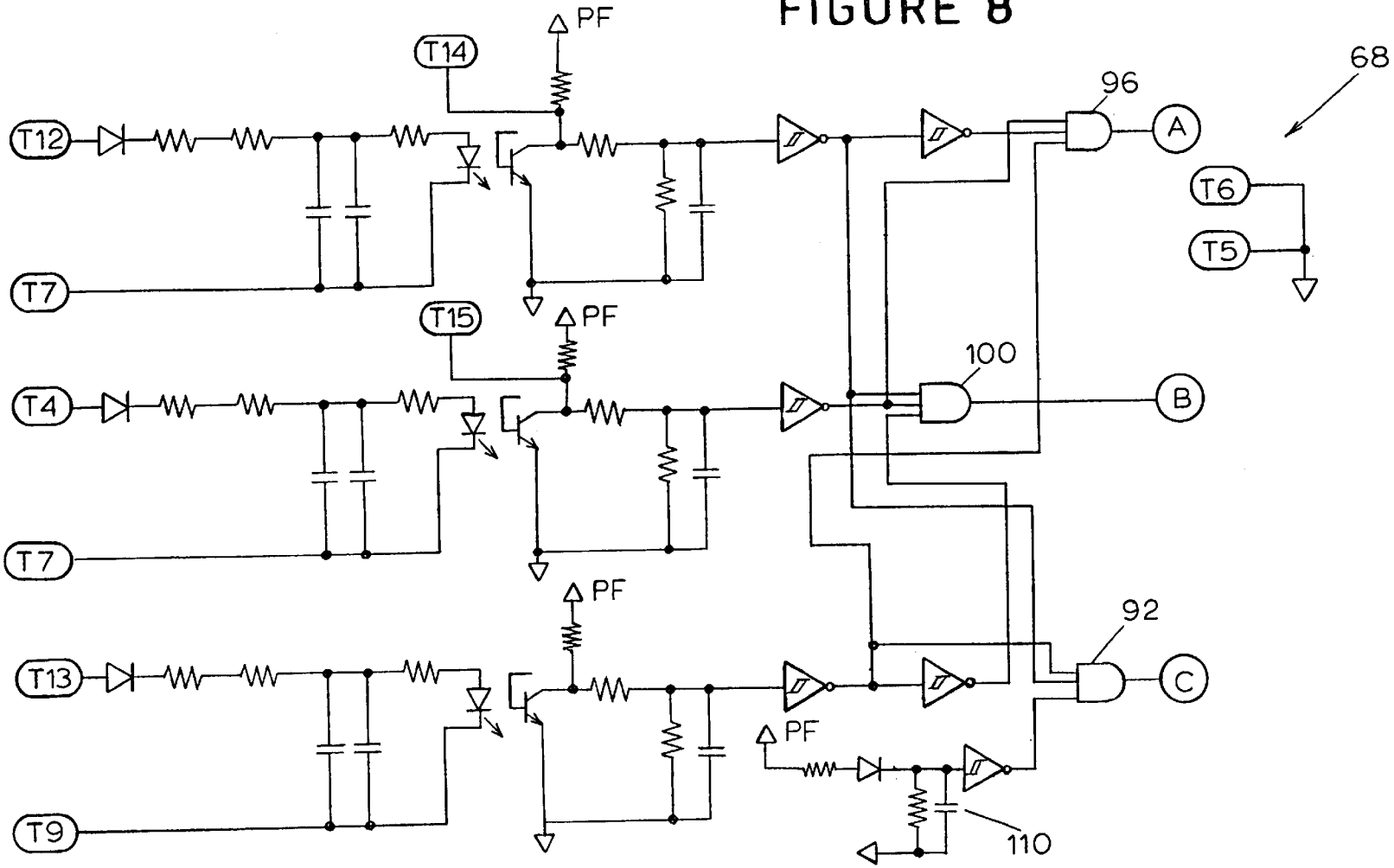
Figure 9:
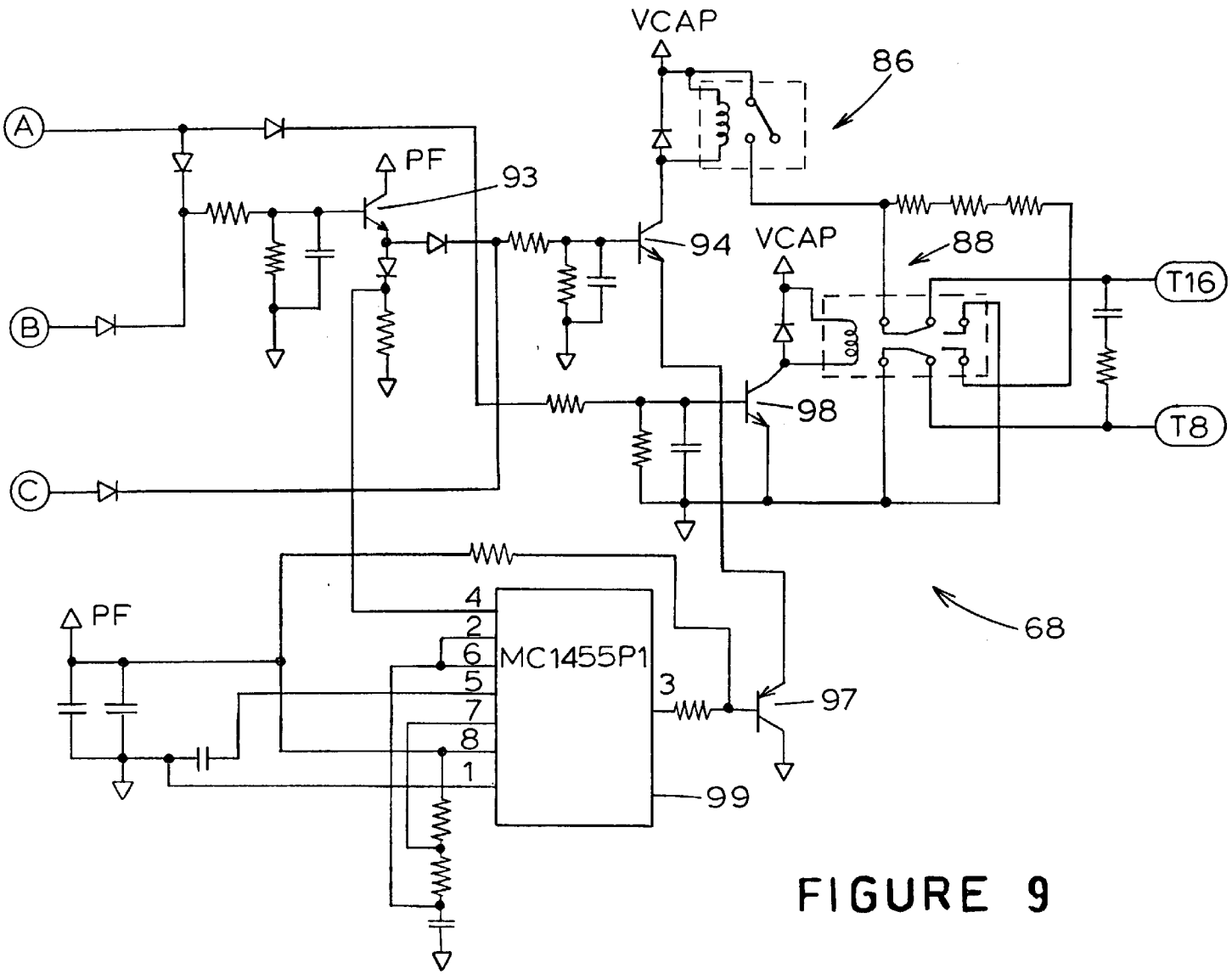
Figure 10:
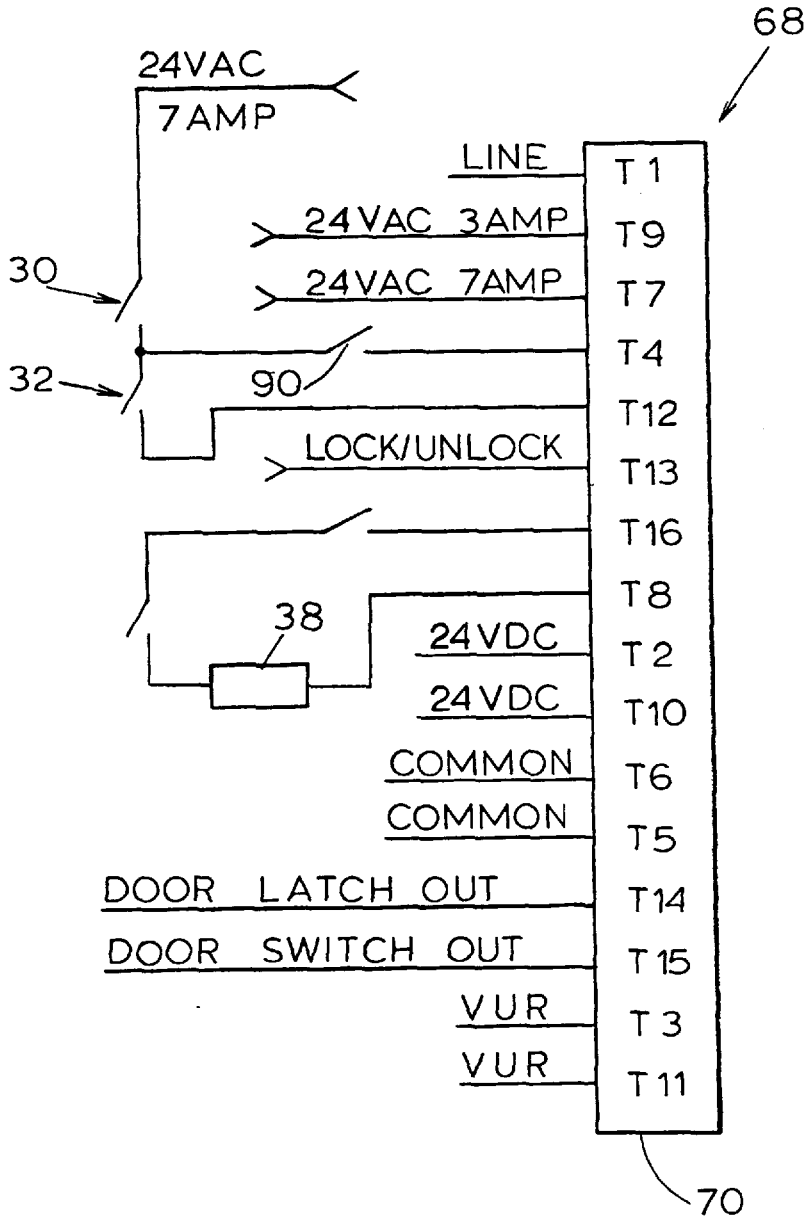

The door interlock control circuit 68 includes a power supply 66 which is shown in FIG. 7 and which receives line voltage over terminals T1 and T9. The alphanumeric terminals shown in FIGS. 7–9 are connected to a connector block 70 shown in FIG. 10. The connector block 70 interfaces with the appliance controller discussed above.

The power supply 66 is arranged to supply unregulated DC voltage at point 72, to supply +24 VDC at point 74, and to supply +12 VDC at point 76. A voltage regulator 78 provides regulated DC to the points 74 and 76 and also to pulse capacitors 80 which are connected to the output of the voltage regulator 78 through a resistor 82 and a diode 84. Accordingly, charging current is supplied to the pulse capacitors 80. The pulse capacitors 80 are arranged, as described below, to supply pulses to the solenoid actuator 38 in order to operate the latch 24 between its lock and unlock positions. The capacitances of the pulse capacitors 80 and the resistance of the resistor 82 may be selected so as to match the duty cycle of the solenoid actuator 38. For example, if the solenoid actuator 38 has a 5% duty cycle, the pulse capacitors 80 and the resistor 82 may be selected to provide a two second time delay.

A pulse relay 86 (FIG. 9), when energized, connects a pulse from the pulse capacitors 80 through a reversing relay 88 to terminals T16 and T8 which are connected through the connector block 68 to the solenoid actuator 38. The reversing relay 88 controls the direction of flow of the pulse from the pulse capacitors 80 through the pulse relay 86 and the solenoid actuator 38.

When the pivot arm 20 is rotated in order to begin the process of locking the door, the door switch 30 (FIG. 10) closes which sends a signal through a door reed switch 90 over terminal T4 in order to condition an AND gate 96 to switch upon receipt of a LOCK signal at a terminal T13. Also, when the door switch 30 closes, a signal is sent over terminal T15 to the appliance controller in order to notify the appliance controller that the appliance door is closed and that the pivot art 20 is in its lock position. Thereafter, the appliance controller sends a LOCK signal over terminal T13 which causes the output of the AND gate 96 to go high in order to turn on a transistor 93 and a transistor 98. When the transistor 98 turns on, the reversing relay 88 is energized which moves its moveable contacts to the position other than that shown in FIG. 9 so that pulses can be supplied to the solenoid actuator 38 in a direction to move the latch projection 54 into the latch recess 56. When the transistor 93 turns on, a transistor 94 is turned on, and the monostable multivibrator 99 is no longer reset. Accordingly, the monostable multivibrator 99 is allowed to switch its output. When the monostable multivibrator 99 switches, a transistor 97 is switched on so that current can pass through the pulse relay 86, and the transistors 94 and 97 in order to close the contacts of the pulse relay 86. Accordingly, the pulse relay 86 allows the pulse capacitors 80 to send a pulse through the reversing relay 88 to the solenoid actuator 38 which causes the solenoid actuator 38 to operate the latch 24 so that the latch projection 54 enters the latch recess 56 of the pivot arm 20, thereby locking the appliance door closed.

When the latch 24 is so operated, the latch switch 32 closes which sends a signal over terminal T12 causing the transistors 93, 94, 97, and 98 to deenergize. When the transistor 98 deenergizes, the reversing relay 88 deenergizes which returns its moveable contacts to the position shown in FIG. 9. Also, a DOOR LATCH OUT signal is sent through terminal T14 in order to notify the appliance controller that the appliance is now locked. On the other hand, if the solenoid actuator 38 fails to operate the latch 24 to its lock position so that the latch switch 32 consequently fails to close, the monostable multivibrator 99 continues to control the transistor 97 so to cause successive pulses to be supplied to the solenoid actuator 38 through the closed contacts of the pulse relay 86.

When the appliance controller determines that the appliance has completed its program, the appliance controller causes the terminal T13 to go low which switches the AND gate 100 to turn on the transistor 93. When the transistor 93 turns on, the transistor 94 is turned on. Also, the monostable multivibrator 99 is no longer reset. Accordingly, the monostable multivibrator 99 turns on the transistor 97 permitting current to flow through the pulse relay 86 and the transistors 94 and 97. When the pulse relay 86 is energized, its contacts close permitting the pulse capacitors 80 to supply a pulse through the contacts of the reversing relay 88 in a direction to cause the solenoid actuator 32 to withdraw the latch projection 54 from the latch recess 56. This pulse, which now flows through the solenoid actuator 38 in the opposite direction, operates the latch 24 to withdraw the latch projection 54 from the latch recess 56. Accordingly, the pivot arm 20 is unlocked allowing the appliance door to be opened. The monostable multivibrator 99 ensures the continuation of pulses to the solenoid actuator 38 until the latch switch 32 opens.

Power is conserved by pulse energizing the solenoid actuator 38. The components shown in FIGS. 7–10 may be selected so that each pulse supplied by the pulse capacitors 80 to the solenoid actuator 38 is 100 milliseconds in duration.

Moreover, the pulse capacitors 80 are isolated from the power supply by the diode 84. Accordingly, the pulse capacitors 80 can supply enough energy for the solenoid actuator 38 without pulling down the power supply 66 so that adequate power may still be supplied to the circuits shown in FIGS. 8 and 9. Furthermore, a single solenoid actuator 38 is used in the door interlock 10 thus allowing the door interlock 10 to be of compact size.

Should a power failure occur while the door interlock 10 is locked, the door interlock 10 continues to be mechanically locked due to gravity, as discussed above. Power is removed from the monostable multivibrator 99 which, consequently, conditions the transistor 97 to conduct. Thus, when a capacitor 110 discharges after a predetermined time following a power failure, the AND gate 92 switches to turn on the transistor 94. Current flow from the pulse capacitors 80 of the power supply 66 through the transistors 94 and 97 energizes the pulse relay 86 so that the pulse capacitors 80 supply a pulse through the reversing relay 88 to the solenoid actuator 38. Accordingly, the latch projection 54 is withdrawn from the latch recess 56 in order to unlock the door interlock 10. The delay provided by the capacitor 110 allows any moving parts of the appliance on which the door interlock 10 is used to stop before the appliance door is electrically unlocked.

Certain modifications of the present invention have been discussed above. Other modifications will occur to those practicing in the art of the present invention. For example, as described above, the solenoid actuator 38 operates the latch 24. Instead, other actuators, such as a piezoelectric actuator, a motor, or the like, may operate the latch 24.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A door interlock comprising:

a pivot arm having a door lock position and a door unlock position, wherein the pivot arm has a latch recess;

a latch having a door lock position and a door unlock position, wherein the latch has a latch projection; and, electromagnetic latch operating means, for moving the latch to its door lock position responsive to the pivot arm being moved to its door lock position to cause the latch projection of the latch to be moved in a first direction to be seated within the latch recess of the pivot arm, and for moving the latch to its door unlock position to cause the latch projection of the latch to be moved in a second direction to be withdrawn from the latch recess of the pivot arm and so that the pivot arm is released for movement to its door unlock position, the electromagnetic latch operating means further comprising:

a latch operating solenoid, wherein the latch operating solenoid is mechanically linked to the latch; and solenoid operating means for operating the latch operating solenoid to move the latch to its door lock position when the pivot arm is moved to its door lock position and for operating the latch operating solenoid to move the latch to its door unlock position to permit the pivot arm to be moved to its door unlock position, the solenoid operating means further comprising:

an actuator arm, wherein the actuator arm is moved to a first actuator arm position when the pivot arm is moved to its door lock position, and wherein the actuator arm is moved to a second actuator arm position when the pivot arm is moved to its door unlock position;

a door switch, wherein the door switch is in a first door operational state when the actuator arm is in its first position, and wherein the door switch is in a second door switch operational state when the actuator arm is in its second position; and a control circuit, wherein the control circuit is responsive to the first door switch operational state to energize the latch operating solenoid in a first direction in order to move the latch to its door lock position and to energize the latch operating solenoid in a second direction in order to move the latch to its door unlock position.

2. The door interlock of claim 1 wherein the solenoid operating means comprises a latch switch, wherein the latch switch is operated to a first latch switch operational state when the latch is in its door lock position, wherein the latch switch is operated to a second latch switch operational state when the latch is in its door unlock position, wherein the latch switch in the first latch switch operational state conditions the latch operating solenoid to be energized in the second direction, and wherein the latch switch in the second latch switch operational state conditions the latch operating solenoid to be energized in the first direction.

3. The door interlock of claim 2 wherein the solenoid operating means comprises pulsing means for pulsing the latch operating solenoid in the first direction in order to move the latch to its door lock position and for pulsing the latch operating solenoid in the second direction in order to move the latch to its door unlock position.

4. The door interlock of claim 3 wherein the pulsing means comprises a capacitor, and wherein the capacitor is arranged to pulse the latch operating solenoid without pulling down a power supply of the control circuit.

5. The door interlock of claim 4 wherein the control circuit comprises a resistor connecting the capacitor to the power supply, wherein the resistor and the capacitor have values matching a duty cycle of the latch operating solenoid.

6. The door interlock of claim 5 wherein the control circuit comprises first and second relays, wherein the first and second relays are controlled by the door switch and the latch switch, wherein the first relay is arranged to control a supply of pulses from the capacitor to the latch operating solenoid, and wherein the second relay is arranged to control whether the latch operating solenoid is pulsed in the first or second direction.

7. A door interlock comprising:

a pivot arm having a door lock position and a door unlock position, wherein the pivot arm has a latch recess;

a latch having a door lock position and a door unlock position, wherein the latch has a latch projection; and electromagnetic latch operating means, for moving the latch to its door lock position responsive to the pivot arm being moved to its door lock position to cause the latch projection of the latch to be moved in a first direction to be seated within the latch recess of the pivot arm, and for moving the latch to its door unlock position to cause the latch projection of the latch to be moved in a second direction to be withdrawn from the latch recess of the pivot arm and so that the pivot arm is released for movement to its door unlock position, the electromagnetic latch operating means comprising:

a capacitor, wherein the capacitor supplies pulses to the electromagnetic latch operating means in order to operate the latch between its door lock and unlock positions without pulling down a power supply for the capacitor.

8. The door interlock of claim 7 wherein the electromagnetic latch operating means comprises a latch operating solenoid, wherein the latch operating solenoid is mechanically linked to the latch, wherein the latch operating solenoid is arranged to drive the latch, wherein the power supply comprises a resistor connected to the capacitor, and wherein the resistor and the capacitor have values matching a duty cycle of the latch operating solenoid.

9. The door interlock of claim 8 wherein the latch operating means comprises first and second relays, wherein the first and second relays are responsive to the pivot arm and the latch, wherein the first relay is arranged to control a supply of pulses from the capacitor to the latch operating solenoid, and wherein the second relay is arranged to control whether the latch operating solenoid is pulsed in a first or second direction.

10. A door interlock for a door of a horizontal axis washer comprising:

a pivot arm for locking the door, the pivot arm having a door lock position and a door unlock position;

a latch having a door lock position against the pivot arm and a door unlock position releasing the pivot arm;

a latch operating solenoid, wherein the latch operating solenoid is mechanically linked to the latch;

solenoid operating means for operating the latch operating solenoid to move the latch to its door lock position responsive to the pivot arm being moved to its door lock position and for operating the latch operating solenoid to move the latch to its door unlock position to permit the pivot arm to be moved to its door unlock position, the solenoid operating means comprising:

an actuator arm, wherein the actuator arm is moved to a first actuator arm position when the pivot arm is moved to its door lock position, and wherein the actuator arm is moved to a second actuator arm position when the pivot arm is moved to its door unlock position, a door switch, wherein the door switch is in a first door switch operational state when the actuator arm is in its first position, and wherein the door switch is in a second door switch operational state when the actuator arm is in its second position; and a control circuit, wherein the control circuit is responsive to the first door switch operational state to energize the latch operating solenoid in a first direction in order to move the latch to its door lock position and to energize the latch operating solenoid in a second direction in order to move the latch to its door unlock position.

11. The door interlock of claim 10 wherein the solenoid operating means comprises a latch switch, wherein the latch switch is operated to a first latch switch operational state when the latch is in its door lock position, wherein the latch switch is operated to a second latch switch operational state when the latch is in its door unlock position, wherein the latch switch in the first latch switch operational state condition the latch operating solenoid to be energized in the second direction, and wherein the latch switch in the second latch switch operational state conditions the latch operating solenoid to be energized in the first direction.

12. The door interlock of claim 11 wherein the solenoid operating means comprises pulsing means for pulsing the latch operating solenoid in the first direction in order to move the latch to its door lock position and for pulsing the latch operating solenoid in the second direction in order to move the latch to its door unlock position.

13. The door interlock of claim 12 wherein the pulsing means comprises a capacitor, and wherein the capacitor is arranged to pulse the latch operating solenoid without pulling down a power supply of the control circuit.

14. The door interlock of claim 13 wherein the control circuit comprises a resistor connecting the capacitor to the power supply, wherein the resistor and the capacitor have values matching a duty cycle of the latch operating solenoid.

15. The door interlock of claim 14 wherein the control circuit comprises first and second relays, wherein the first and second relays are controlled by the door switch and the latch switch, wherein the first relay is arranged to control a supply of pulses from the capacitor to the latch operating solenoid, and wherein the second relay is arranged to control whether the latch operating solenoid is pulsed in the first or second direction.

16. A door interlock for a door of a horizontal axis washer comprising:

a pivot arm for locking the door, the pivot arm having a door lock position and a door unlock position;

a latch having a door lock position against the pivot arm and a door unlock position releasing the pivot arm;

a latch operating solenoid, wherein the latch operating solenoid is mechanically linked to the latch; and solenoid operating means for operating the latch operating solenoid to move the latch to its door lock position responsive to the pivot arm being moved to its door lock position and for operating the latch operating solenoid to move the latch to its door unlock position to permit the pivot arm to be moved to its door unlock position; the solenoid operating means comprising:

a capacitor, wherein the capacitor supplies pulses to the latch operating solenoid to drive the latch between its door lock and unlock positions without pulling down a power supply for the capacitor.

17. The door interlock of claim 16 wherein the power supply comprises a resistor connected to the capacitor, and wherein the resistor and the capacitor have values matching a duty cycle of the latch operating solenoid.

18. The door interlock of claim 16 wherein the solenoid operating means comprises first and second relays, wherein the first and second relays are responsive to the pivot arm and the latch, wherein the first relay is arranged to control a supply of pulses from the capacitor to the latch operating solenoid, and wherein the second relay is arranged to control whether the latch operating solenoid is pulsed in a first or second direction.

19. A door interlock comprising:

a pivot arm having a door lock position and a door unlock position;

a latch having a door lock position against the pivot arm and a door unlock position releasing the pivot arm;

a latch operating actuator, wherein the latch operating actuator is mechanically linked to the latch;

a power supply;

a capacitor supplied by the power supply, wherein the capacitor, responsive to movement of the pivot arm from the door unlock to the door lock position, is arranged to pulse the latch operating actuator without pulling down the power supply, wherein the pulsing of the latch operating actuator by the capacitor causes the latch operating actuator to move the latch from its door unlock position to its door lock position;

a latch block, wherein the latch block is arranged to cover at least a portion of the pivot arm and the latch so as to restrict access to the latch when the latch and pivot arm are in their door lock positions;

a door switch, wherein the door switch is in a first door switch operational state when the pivot arm is in its door lock position, and wherein the door switch is in a second door switch operational state when the pivot arm is in its door unlock position; and a control circuit, wherein the control circuit is responsive to the first door switch operational state to cause the capacitor to pulse the latch operating actuator in a first direction in order to move the latch to its door lock position and to cause the capacitor to pulse the latch operating actuatorin a second direction in order to move the latch to its door unlock position.

20. The door interlock of claim 19 further comprising a latch switch, wherein the latch switch is operated to a first latch switch operational state when the latch is in its door lock position, wherein the latch switch is operated to a second latch switch operational state when the latch is in its door unlock position, wherein the latch switch in the first latch switch operational state conditions the capacitor to pulse the latch operating actuator in the first direction, and wherein the latch switch in the second latch switch operational state conditions the capacitor to pulse the latch operating actuator in the second direction.

21. The door interlock of claim 20 wherein the power supply comprises a resistor connected to the capacitor, and wherein the resistor and the capacitor have values matching a duty cycle of the latch operating actuator.

22. The door interlock of claim 21 wherein the control circuit comprises first and second relays, wherein the first and second relays are controlled by the door switch and the latch switch, wherein the first relay is arranged to control a supply of pulses from the capacitor to the latch operating actuator, and wherein the second relay is arranged to control whether the latch operating actuator is pulsed in the first or second direction.

* * * * *